United States Patent [19]

Machamer

[11] 4,382,688

[45] May 10, 1983

[54] TIMED MEDICATION DISPENSER

[76] Inventor: Roy J. Machamer, 615 Harbin La., Reno, Nev. 89509

[21] Appl. No.: 228,146

[22] Filed: Jan. 26, 1981

[51] Int. Cl.[3] ..... G04B 47/00; G04C 21/16; G08B 5/00

[52] U.S. Cl. ..... 368/10; 368/251; 340/309.4; 221/2

[58] Field of Search ..... 368/9, 10, 107–113; 340/309.1–309.4; 221/2, 3; 206/533, 534

[56] References Cited

U.S. PATENT DOCUMENTS

| | | | |
|---|---|---|---|
| 4,223,801 | 9/1980 | Carlson | 368/10 X |
| 4,258,354 | 3/1981 | Carmon et al. | 368/10 X |
| 4,275,384 | 6/1981 | Hicks et al. | 340/309.4 |
| 4,293,845 | 10/1981 | Villa-Real | 340/309.4 |

*Primary Examiner*—Vit W. Miska

*Attorney, Agent, or Firm*—Majestic, Gallagher, Parsons & Siebert

[57] ABSTRACT

A medical dispenser having an electronic reminder to take the medication which is disabled upon the user doing so.

8 Claims, 2 Drawing Figures

TIMED MEDICATION DISPENSER

BACKGROUND OF THE INVENTION

This invention relates generally to an electronic timing device for reminding an individual when medication is to be taken and affirming that action when done. Many mechanical and electrical pillboxes and timers have been suggested for reminding prescription users to take medication at proper intervals. Examples of such devices are found in the following U.S. Pat. Nos. 2,853,182, 2,948,106, 3,474,617, 3,739,740, 4,034,757, and 4,084,415.

It is a primary object of the present invention to provide a portable, battery operated, electronically controlled timer that operates in conjunction with a medication dispenser to remind the user to take medication on a periodic basis.

It is another object of the invention to provide a medication dispenser and an electronic reminder that permits a wide variety of pill cycles to be utilized such as daily, alternating days or other non-daily routines.

It is a further object of the present invention to provide a timer and dispenser that are especially adapted for use with birth control pills.

SUMMARY OF THE INVENTION

These and additional objects are accomplished by the present invention wherein, briefly, an electronic timer, such as an available electronic watch module, is incorporated into a portable, hand held case that includes a compartment for the pills or other medication. The alarm of the timer is set to remind the user to take the medication. The alarm is terminated or disabled upon the medication compartment being opened by the user to remove medication from it. Electronic memory means are provided, in accordance with one form of the invention, to cause the alarm to provide the reminder at pre-set intervals that differ from those available by use of a standard commercially available electronic watch module alone.

Additional objects, advantages and features of the various aspects of the present invention will become apparent from the following description of its preferred embodiments, which should be taken in conjunction with the accompanying drawings.

DESCRIPTION OF THE PREFERRED EMBODIMENTS

Figure 1:
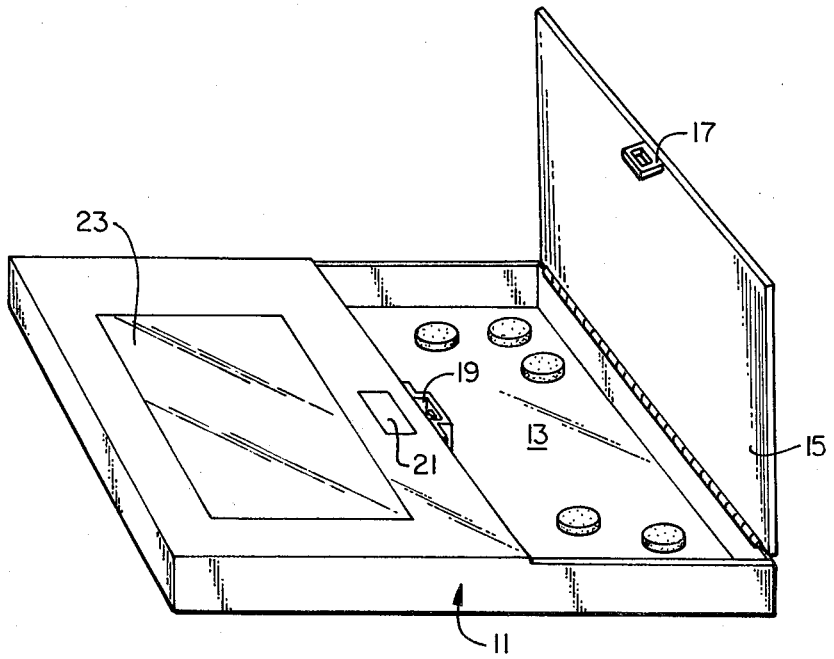
FIG. 1 illustrates an example of a portable, hand held pill dispenser with electronic timer, in accordance with the present invention.

Referring to FIG. 1, a hand held case 11 includes a compartment 13 for containing pills or other medication. This compartment is enclosed by a hinged cover 15 that has a latching member 17 that cooperates with a mating latching member 19 that is attached to the case 11. When the cover 13 is closed, the latching element 17 and 19 secure the door in the closed position until released by pushing a mechanical button 21. Transparent sheet material 23 covers a liquid crystal display (LCD) of a watch module that is carried there beneath within the case 11.

Figure 2:
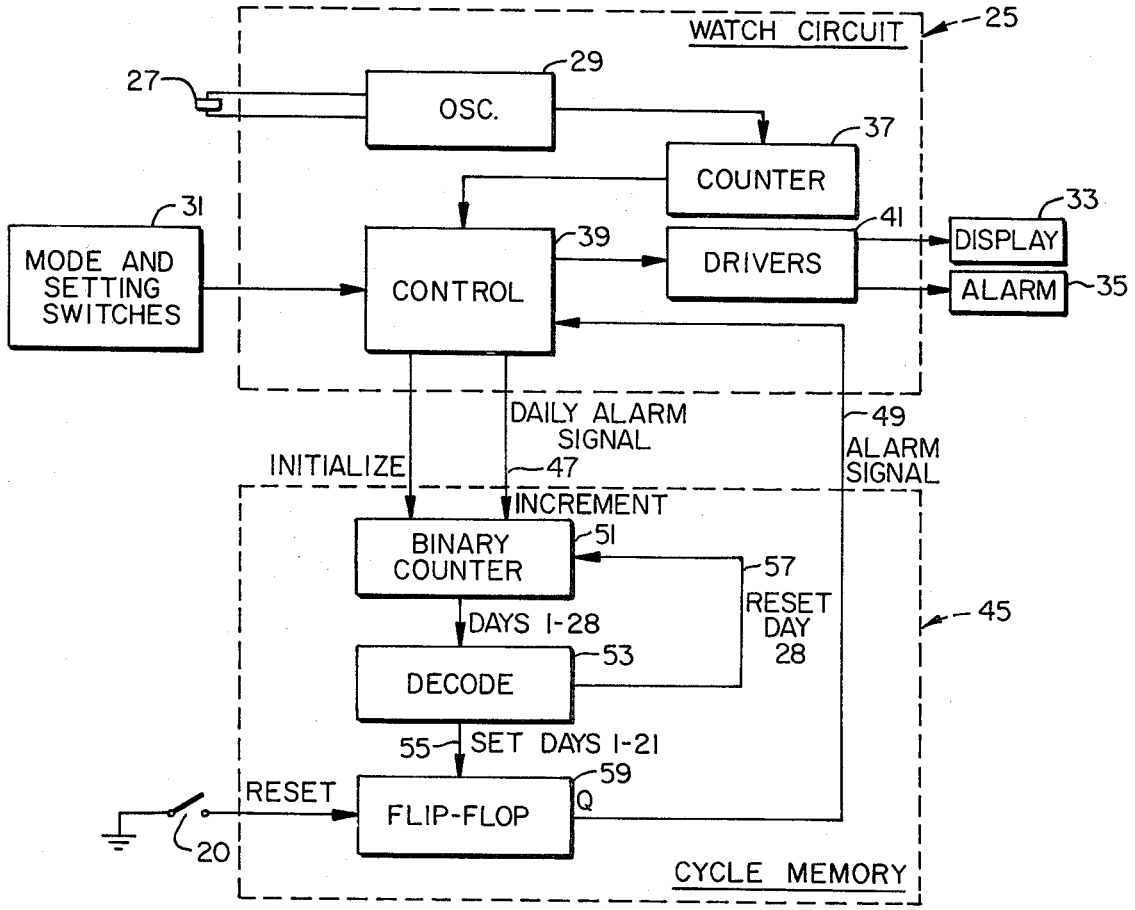
FIG. 2 is an electronic block diagram of a timing circuit for the medication dispenser of FIG. 1.

Referring to FIG. 2, a specific example of the electronic timing and reminder system within the case 11 of FIG. 1 is illustrated. A standard watch circuit 25 of the type commonly used in electronic alarm watch modules is utilized. Associated with it are other elements of a standard watch module: a crystal 27 that controls its oscillator 29, switches 31 for setting and controlling the mode of operation of the watch circuit, a digital display 33, preferably of the LCD type positioned under the transparent layer 23 of FIG. 1, and an audible alarm 35. The watch circuit includes a counter 37, control circuits 39 and driving circuits 41 to provide the display and alarm. What has been described so far are the parts to a standard alarm watch module. The alarm is settable through the control circuits 39 from the external mode and setting switches 31 to sound out at least one set time each day. The alarm 35 is, additionally, some visual indicator, such as a flashing of the time display 33 or part thereof.

Added to work in cooperation with the watch module is a cycle memory 45. This circuit is interposed in a alarm control signal path 47, 49, of the watch circuit 25. That is, the normal watch module internally generates its own alarm control signal, but in this case a circuit for doing that has been broken and the alarm cycle memory 45 interposed to provide additional control to the alarm circuit. The cycle memory 45 receives the normal alarm signal in a line 47 as generated by an electronic watch module at a particular time or times each day. The cycle memory 45 disables some of these signals so the alarm control signal provided in the line 49 back to the watch circuit 25 is further controlled in accordance with the cycle of medication that the user of the device is taking.

The cycle memory 45 of FIG. 2 is designed to implement a particular medication cycle, this example being that of a birth control pill where one pill is to be taken each day for 21 days in succession and then no pill taken for the next 7. It is this 28 day cycle that the particular cycle memory 45 of FIG. 2 is given as an example of the present invention.

The alarm signal in line 47 is provided once each day at the time set in the watch circuit 25 to a binary counter 51. The counter 51 is incremented one count each time the alarm signal occurs in the line 47. An output of the counter 51 is connected to a decoding circuit 53 which, in this case, emits an output in a line 55 each time the counter 51 is incremented one count between the counts of 1 through 21. The circuit 53 blocks any output from occurring in the line 55 for the counts 22 through 28 of the counter 51. Further, the circuit 53 emits a reset pulse in a line 57 that is applied to the counter 51 to reset it to an output corresponding to day 1 to begin the cycle over again. A flip-flop circuit 59 is set by a pulse in the line 55 and it is the output of this flip-flop that is connected back through circuit 49 to the watch circuit 25. When the flip-flop 59 is set, it allows the watch circuit 25 to initiate the alarm 35, a periodic sound and a continuous visual indicator 33. The alarm is terminated only when the flip-flop 59 is reset so providing affirmation the action was taken, this being done by closing a switch 20. The switch 20 is positioned in conjunction with the latch 19 (FIG. 1) in a manner that is closed when the medication compartment cover 15 is opened.

Thus, the alarm is terminated by opening the medication compartment, the action that the alarm is designed to remind the user to take and affirming action has been accomplished. A separate button to disable the alarm could also be provided in order to give the user the choice, once reminded, of taking the medication or not. The particular example of FIG. 2 automatically disables the alarm for those days that the user need not take the birth control pill. If another type of birth control pill is utilized that needs to be taken by the user every day, the decoding circuit 53 is modified to emit a set pulse in the line 55 every day. A control could be provided so that the user could set the decoding circuits 53 for the 21 day or 28 day cycle by manipulating an external switch.

If the device is to be used to only dispense medication each day, whether a birth control or some other pill or medication, the counter 51 and decoding circuit 53 need not be employed, the line 47 being connected directly to the set input of the flip-flop 59. This would eliminate the capability of the cycle memory 45 to disable the alarm on some periodic basis but maintain the alarm and affirm action since the reset to 59 is required. For other medication cycles, such as every other day or every third day, the counter 51 and decoder 53 would remain in place, but the decoding circuit 53 would be altered so that it emitted a set pulse in the line 55 only on every other count of the counter 51 (for an every other day medication reminder), or on every third count (for a medication reminder every third day). Further variations are possible, such as emitting an alarm signal in the line 47 more than once each day, with commonly used watch modules. The technique described is completely general for providing a medication cycle reminder as required by the particular medication to be taken. A more elaborate system could include programmable controls by the user of the decoding circuit 53 to set any medication reminder that is desired.

The use of a commercially available electronic watch module is preferred because of their availability and the module is then modified to include the cycle memory 45. Of course, a single purpose circuit could be devised which would eliminate parts of the electronic watch module that are not particularly necessary for the purposes of a medication reminder.

By using low power, battery driven technology evolved for watches, a long life, accurate, pocket-sized device is provided for reminding the user to take medication. The device is simple to operate that requires virtually no user action other than removing the pill or other medication from the medication compartment of the device. The device also incidentally provides all of the functions of an electronic clock.

Although the various aspects of the present invention have been described with respect to a few specific examples thereof, it will be understood that the invention is entitled to protection within the full scope of the appended claims.

I claim:

1. A medication dispenser, comprising:

a hand-held, portable case having a medication compartment therein with a lid that is normally held closed by a manually operable latch, whereby the lid is opened to access the medicine compartment by operating the latch by hand, a switch mounted adjacent said latch to detect when the lid has been opened, an electronic watch module mounted within said case, said module including an alarm that provides an indication at least once each day at a preset time in response to a signal along a path from controlling electronics of said module, electronic memory means connected in said signal path for disarming said alarm in accordance with a preset pattern, thereby to provide an alarm indication only upon selected ones of said alarm preset times, and means connecting said switch into the watch module alarm signal path for terminating the alarm indication once initiated, whereby the alarm is terminated upon the medication compartment lid being opened to remove medication therefrom, thereby to thereafter indicate that the medication has been taken.

2. The medication dispenser according to claim 1 wherein said electronic memory means is programmed to disarm the alarm for substantially seven days out of a twenty-eight day repetitive cycle, the alarm being operable for substantially twenty-one consecutive days of the cycle, whereby said dispenser is especially adapted for dispensing birth control pills.

3. The medication dispenser according to claim 1 wherein said electronic memory means is programmed to disarm the alarm at every other occurrence whereby said dispenser is especially adapted for dispensing medication every other day.

4. A medication dispenser, comprising:

a hand-held, portable case having a medication compartment therein with an openable cover that is normally held closed, whereby the cover may be opened to access the medicine compartment, means mounted in association with said compartment and cover for emitting an alarm disabling signal when the lid is opened, an electronic watch circuit mounted within said case, said watch circuit including an alarm that normally provides an indication in response to a periodic alarm initiation signal from controlling electronics of said watch circuit, electronic memory means connected to intercept said initiation signal before reaching said alarm for supressing certain of said signals in accordance with a preset pattern, thereby to provide an alarm indication only upon selected areas of said periodic alarm initiation signals, and means connecting said emitting means into the watch module alarm signal path for terminating the alarm indication once initiated, whereby the alarm is terminated upon the medication compartment lid being opened to remove medication therefrom, thereby to thereafter indicate that the medication has been taken.

5. The medication dispenser according to claim 4 wherein said electronic means emits said alarm signal once each day, and wherein said electronic memory means is programmed to suppress said alarm signal for a first number of consecutive days out of a particular duration of a number of days, the alarm being operable for the remaining consecutive days of said duration, whereby said dispenser is especially adapted for dispensing medication on a nonperiodic basis, such as birth control pills.

6. The medication dispenser according to claim 6 wherein said electronic memory means preset pattern suppresses every Nth alarm initiation signal, where N is an integer of two or more.

7. The medication dispenser according to claim 6 wherein said electronic memory means comprises:

a binary counter connected to receive said alarm initiation signal in a manner to be incremented upon each occurrence of said initiation signal, a decoding logic circuit connected to receive an output of said counter and characterized by emitting an output signal only in response to those counts that are set in said logic circuit, its said output signal then being applied to said alarm.

8. The medication dispenser according to claim 4 wherein said electronic memory means is characterized by being unalterable by a user of the dispenser.

* * * * *